United States Patent [19]

Dieringer

[11] Patent Number: 4,579,061

[45] Date of Patent: Apr. 1, 1986

[54] SPIKE DRIVING MACHINE INCLUDING IMPROVED RAIL CLAMPING APPARATUS

[75] Inventor: Andrew M. Dieringer, Waterford, Wis.

[73] Assignee: Rexnord Inc., Brookfield, Wis.

[21] Appl. No.: 626,812

[22] Filed: Jun. 29, 1984

[51] Int. Cl.[4] ..... E01B 29/26

[52] U.S. Cl. ..... 104/17 R; 104/2

[58] Field of Search ..... 104/7 R, 7 B, 9, 12, 104/17 R, 2

[56] References Cited

U.S. PATENT DOCUMENTS

| | | | |
|---|---|---|---|
| 3,071,082 | 1/1963 | Talboys | 104/7 R X |
| 3,119,346 | 1/1964 | Derler | 104/7 R X |
| 3,274,951 | 9/1966 | Christoff | 104/7 R |
| 3,299,833 | 1/1967 | Stewart | 104/7 R |
| 3,461,810 | 8/1969 | Yard | 104/7 R |
| 3,552,320 | 1/1971 | Traupmann | 104/17 R |
| 4,046,078 | 9/1977 | Theurer | 104/7 R |
| 4,248,154 | 2/1981 | Theurer | 104/7 B |
| 4,273,052 | 6/1981 | Woolner et al. | 104/17 R |
| 4,430,945 | 2/1984 | Theurer | 104/7 B |

FOREIGN PATENT DOCUMENTS

| | | | |
|---|---|---|---|
| 1023257 | 12/1952 | France | 104/17 R |

*Primary Examiner*—David A. Scherbel
*Assistant Examiner*—David F. Hubbuch
*Attorney, Agent, or Firm*—Lawrence J. Crain

[57] ABSTRACT

A spike-driving machine for use in driving spikes into railroad ties and including a rail clamping apparatus for securing the machine to the rails while spikes are being driven into the rails. The rail clamping apparatus can employ only a single hydraulic cylinder and is constructed so as to firmly grip the rails even if the heads of the rails are substantially worn and also constructed so as to grip a variety of different sizes of rails whether or not those rails are new rails or substantially worn.

7 Claims, 5 Drawing Figures

SPIKE DRIVING MACHINE INCLUDING IMPROVED RAIL CLAMPING APPARATUS

FIELD OF THE INVENTION

The present invention is directed to machines for use in driving railroad spikes into the ties of a railroad track to secure tie plates and rails to the ties and more particularly to apparatus for securing the spike driving machine down against the rails when the hydraulic spike driving apparatus of the machine forces the spikes down into the rails.

BACKGROUND PRIOR ART

During operation of a railroad spike driving machine, when the hydraulic spike driving apparatus forces the spikes downwardly into the ties, the complementary upward force on the machine tends to lift the machine off of the rails. Accordingly, most spike driving machines include means for clampingly engaging the rails to secure the machine in place when the spikes are driven into the rails.

One form of clamping means includes a pair of jaws connected to vertically extending hydraulic cylinders supporting the jaws for vertical movement between a raised or retracted position and a lowered rail engaging position. These clamping devices also commonly include hydraulic cylinders for causing clamping engagement of the jaws with the rails. These machines have the disadvantage that they have a relatively complicated rail gripping mechanism and may require four or more hydraulic cylinders to clamp the machine against the rails.

A prior art clamping device manufactured by the assignee of the present invention includes a single horizontally extending cylinder. One end of the cylinder is connected to a clamping member which clampingly engages one rail and the other end of the cylinder is connected to a clamping member adapted to grip the other rail. The clamping members are each pivotally joined to the machine frame and include a jaw member which pivots under the head of the rail and is intended to grip the bottom surface of the head of the rail so as to restrain the machine against the rail. The jaw member is an integral part of the clamping member, and the clamping member is pivotally joined by a pivot pin to the machine frame. While this design is preferable to other prior art constructions in that it requires only a single hydraulic cylinder to cause clamping engagement with both rails, in those cases where the heads of the rails are worn down substantially, and wherein the thickness of metal between the top of the rail and the lower surface of the rail head has been substantially decreased, the clamping jaw member may not achieve a firm clamping engagement with the rail head. When the hydraulic apparatus of the spike driving machine then forces the spike downwardly into the tie, the machine will be lifted off of the rails. Repeated spike driving causes the machine to be repeatedly lifted away from the track and this can cause wear of the spike driving machine and is unacceptable to the operator.

SUMMARY OF THE INVENTION

The present invention provides an improved spike driving machine for forcing spikes into railroad ties and an improved means for securing the machine to the rails while spikes are being driven into the rails. The rail clamping means is constructed so as to firmly grip the rails even if the heads of the rails are substantially worn and also constructed so as to grip a variety of different sizes of rails whether or not those rails are new rails or substantially worn.

More specifically, the present invention includes a machine for driving spikes into railroad ties to secure rails to the ties and including a machine frame having a transverse frame member extending transversely to the longitudinal direction of the rails, wheels for supporting the frame for movement along rails, and means supported by the frame for forcing railroad spikes downwardly into the railroad ties to secure the rails in place. The machine also includes means for securing the transverse frame member to the rails when the means for forcing the spikes into the ties forces the spikes downwardly and to prevent the frame from being lifted away from the rails. The means for securing the frame to the rails includes a clamp member supported for pivotable movement about an axis generally parallel to the longitudinal axis of the rail, and the pivot axis of the clamp member being above the longitudinal axis of the rail, and the clamp member including opposite ends. The axis of pivotable movement of the clamp member is intermediate those opposite ends, and one of the opposite ends defines a jaw member. Means are also provided for causing pivotable movement of the clamp member from a retracted position to a position wherein the jaw member extends under the head, the means for causing pivotable movement including a fluid cylinder having one end pivotably connected to the other of the opposite ends of the clamp member. Means are further provided for supporting the clamping member for pivotal movement from the retracted position to a first rail engaging position wherein the jaw member engages the rail web and then for upward movement to a head engaging position wherein the jaw member engages the rail head.

In a preferred form of the invention the clamping member pivots from the retracted position to the first position when the fluid cylinder extends from a retracted position to a first extended position, and the clamping member moves from the first position to the head engaging position when the fluid cylinder extends further to a second extended position.

One of the features of the invention is the provision of a link having opposite ends, one of the opposite ends of the link being pivotally joined to the transverse frame member, and the clamping member being pivotally joined to the other end of the link.

Various other features and advantages of the invention will be apparent by reference to the following description of a preferred embodiment, from the claims, and from the drawings.

Figure 1:
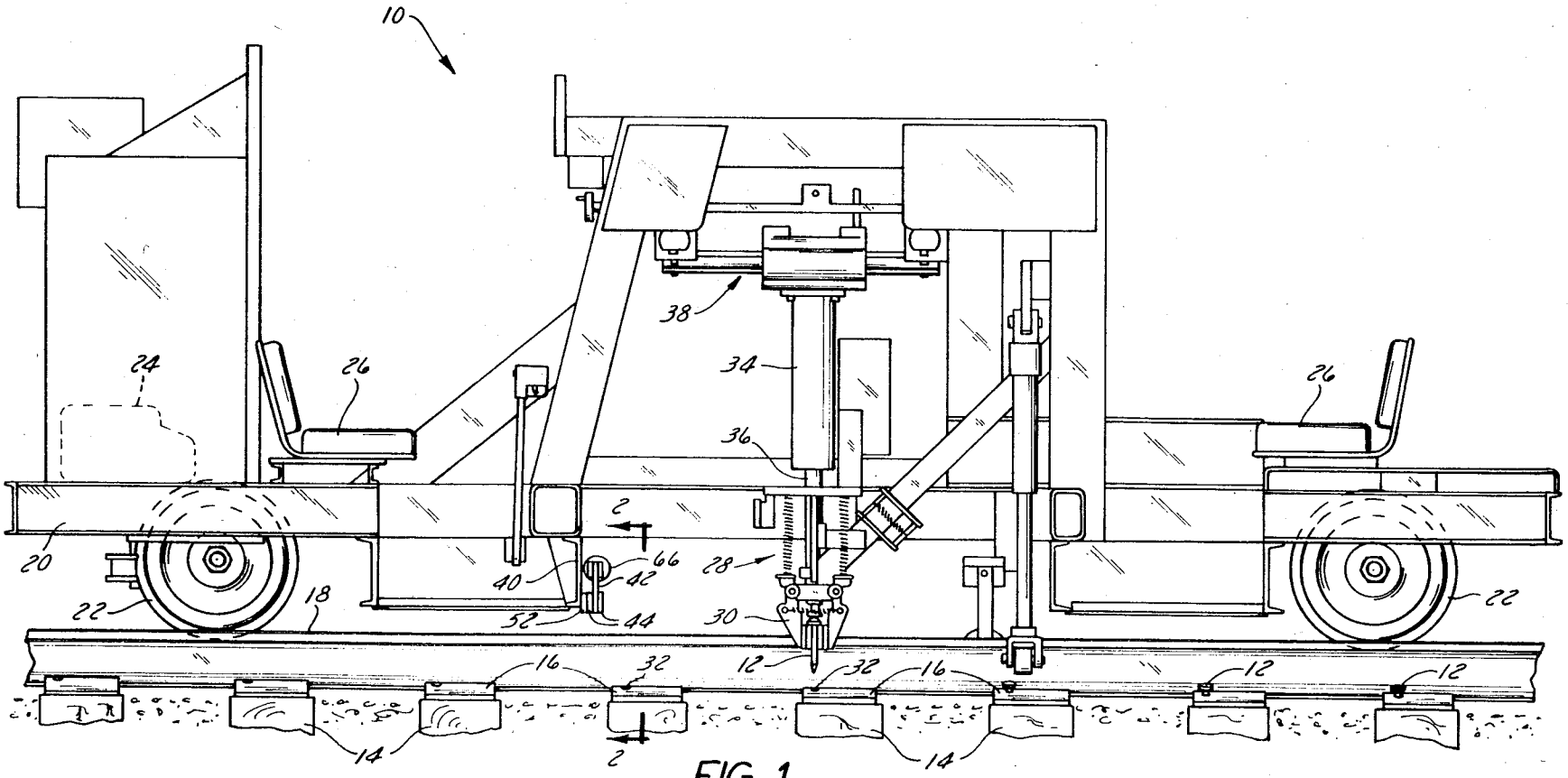
FIG. 1 is a side elevation view of a spike driving machine embodying the present invention.

Before describing a preferred embodiment of the invention in detail, it is to be understood that the invention is not limited in its application to the detailed construction and to the arrangements set forth in the following description nor illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a spike driving machine 10 embodying the present invention and adapted to drive spikes 12 into railroad ties 14 to secure tie plates 16 and rails 18 to the ties 14. The machine 10 includes a frame 20 supported on wheels 22 such that the frame 20 can be driven along the rails 18 of a railroad track. The frame 20 supports a conventional internal combustion engine 24 for driving the machine and a pair of operator's seats 26. The machine 10 also includes a means for driving spikes 12 into railroad ties 14. The spike driving means 28 is conventional and is not shown in the drawings in detail. Generally the spike driving means 28 includes a spike gripping assembly 30 adapted to grip a spike such that it can be properly positioned over a hole 32 in the tie plate 16 and to support the spike 12 such that it can be driven downwardly through the hole 32 into the tie 14. The means for driving the spike into the tie is provided by a hydraulic cylinder 34 including a downwardly extending piston 36 adapted to engage the head of the spike 12 and force it into the tie. A support assembly 38 is also provided for supporting the cylinder 34 and the gripping assembly 30 for adjustable movement with respect to the machine frame 20 to provide for alignment of the spike to be driven with the hole 32.

The frame 20 also includes a transverse frame member 40 extending perpendicularly to the direction of movement of the machine, one end of the transverse frame member 40 being positioned over one of the rails 18 and adjacent the spike driving means 28, and the other end of the transverse frame member 40 positioned over the other of the rails 18. While the transverse frame member 40 could have other constructions, in the illustrated arrangement it is comprised of a beam or channel depending from the frame 20 and having one end welded to one side of the frame 20 and an opposite end welded to an opposite side of the frame 20.

Means are also provided for clamping the machine 10 to the rails 18 when the machine drives spikes 12 into the ties 14, the clamping means including a pair of clamp members 42 (FIGS. 2–4) pivotally supported by the opposite ends of the transverse frame member 40. The clamp members 42 have the same construction and, accordingly, only one of the clamp members 42 will be defined in detail. Each of the clamp members 42 is supported by a pair of parallel pivotable connecting links 44. The connecting links 44 are positioned on opposite sides of the clamp members 42, and one end 46 of each of the links 44 is pivotally joined to the transverse frame member 40, and an opposite end 48 pivotally supports the clamp member 42 for pivotal movement about a pivot axis parallel to the longitudinal axis of the rail 18 and perpendicular to the longitudinal axis of the transverse frame member 40.

More specifically, the links 44 are pivotally connected to the transverse frame member 40 by a pivot pin 50 supported by a bracket 52 which is in turn fixed to the transverse frame member 40, and the opposite ends 48 of the link 44 are pivotally connected to opposite sides of the clamp member 42 by a second pivot pin 54.

Figure 2:
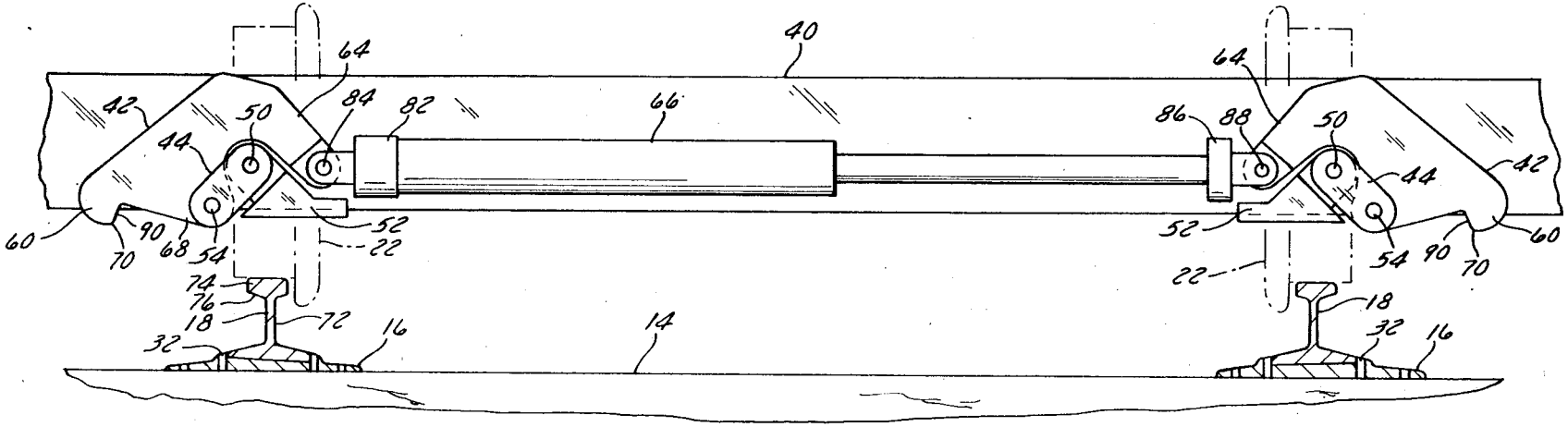
FIG. 2 is a cross section view taken along line 2—2 in FIG. 1.

As illustrated in FIG. 2, the links 44 are supported such that they extend generally downwardly from the upper end of the bracket 52 and away from the central portion of the spike driving machine 10.

In the illustrated construction the clamp member 42 has a bellcrank configuration or "L" shaped construction with one leg of the "L" having an end 60 adapted to clampingly engage a rail 18, and the other leg of the "L" has a free end 64 adapted to be pivotally connected to a hydraulic cylinder 66. The clamp member 42 also includes a projecting portion 68, the projecting portion defining a lobe including a bore housing the pivot pin 54 connecting the lower end 48 of the links 44 to the clamp member 42.

The end 60 of the clamp member 42 adapted to engage the rail 18 defines a jaw portion spaced radially from the pivot axis of the clamp member, and the clamp member is shaped such that as the clamp member pivots from a retracted position (FIG. 2) to a rail engaging position (FIG. 3), the end 70 of the jaw member 60 will contact the web 72 of the rail 18.

Figure 3:
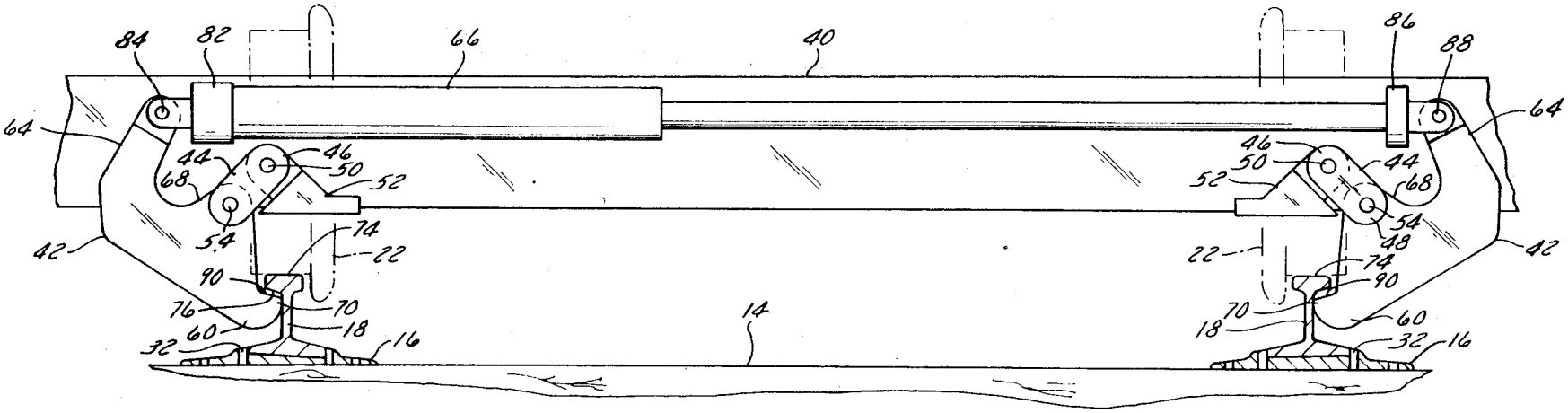
FIG. 3 is a view similar to FIG. 2 but showing the clamp members in a rail engaging position.
Figure 4:
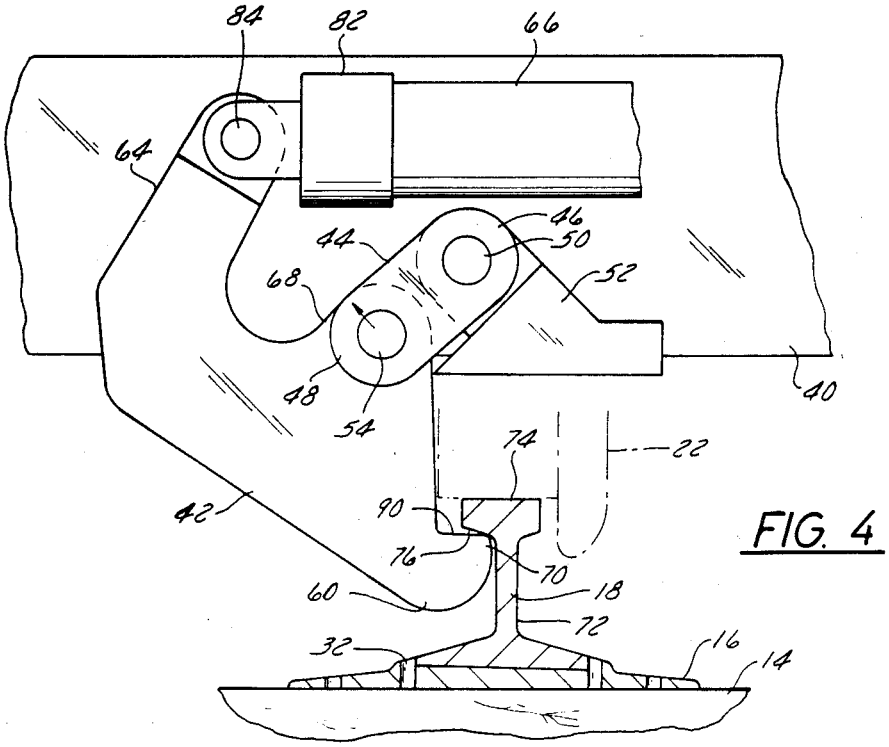
FIG. 4 is an enlarged partial view of apparatus illustrated in FIG. 3 and showing a clamp member in a rail head clamping position.
Figure 5:
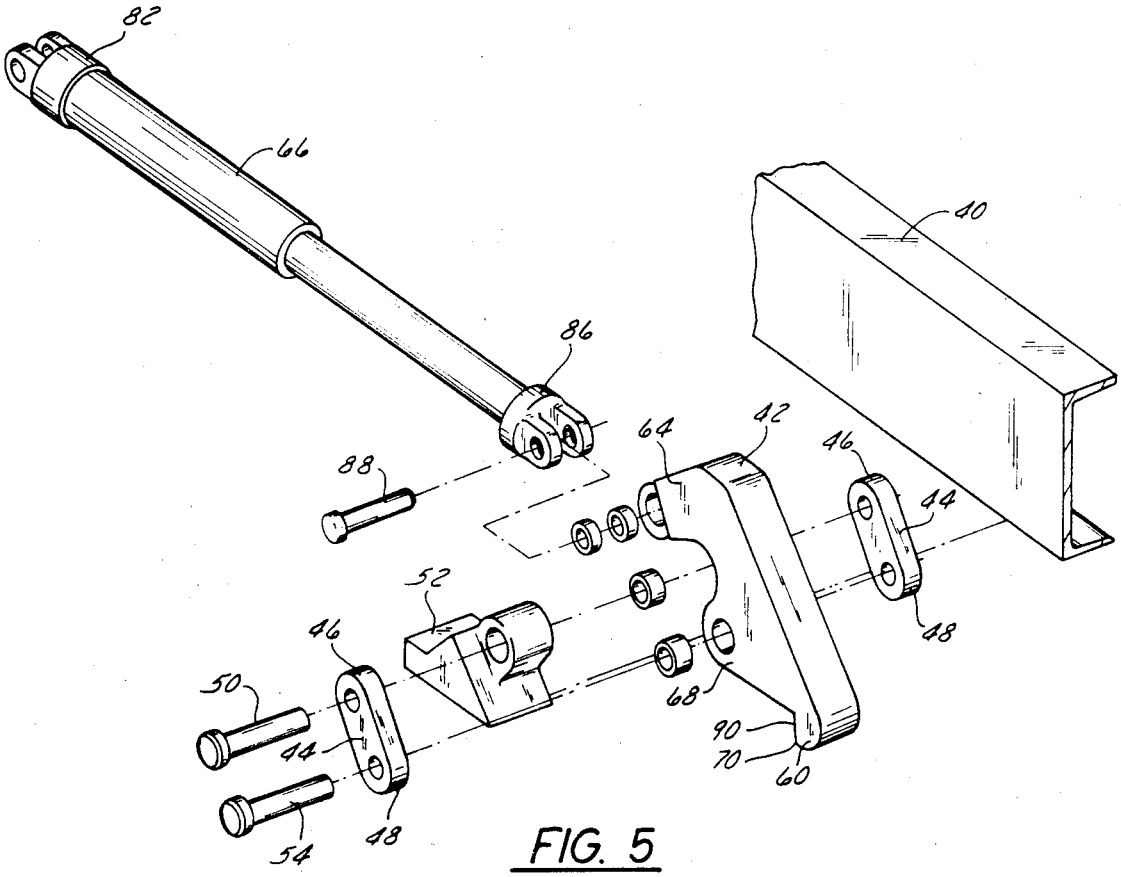
FIG. 5 is an exploded perspective view of rail clamping apparatus illustrated in FIGS. 2–4.

In the event the rail 18 supporting the spike driving machine 10 is a worn rail wherein the rail head 74 will be thinner than the rail head of a new rail, as shown in FIG. 3 the jaw member 60 will be positioned below the lower surface 76 of the rail head 74.

Means are also provided for causing pivotal movement of the clamp members 42 from the retracted position to the position wherein the clamp members 42 clampingly engage the rail 18. In the illustrated arrangement the means for causing clamping movement includes the hydraulic cylinder 66 extending generally horizontally adjacent the transverse frame member and including one end 82 pivotally connected by a pin 84 to one of the clamp members 42 and an opposite end 86 pivotally connected by a pin 88 to the other of the clamp members 42. The ends 82 and 86 of the hydraulic cylinder 66 are pivotally connected to the free ends 64 of the clamp members 42 such that these structures are pivotable with respect to each other about axes parallel to the longitudinal axes of the rails 18.

In operation of the apparatus for causing selective movement of the clamping members 42, extension of the hydraulic cylinder 66 first causes pivotal movement of each of the clamp members 42 from the retracted position to a position wherein the jaw portion 60 extends under the rail head 74 and engages the rail web 72. The clamp member 42 is freely pivotable about the axis of pivot pin 54 such that during initial extension of the cylinder 66, the clamp member 42 will pivot about that pivot pin until the end 60 contacts the rail 18. In the case of a new rail or a rail which is not substantially worn, the surface 90 of jaw 60 will also engage the lower surface 76 of the rail head 74. In the event the rail 18 is worn and the rail head 74 is of reduced height, when the end 70 of the jaw 60 engages the rail web 72, the engaging surface 90 of the jaw 60 will be spaced below the lower surface 76 of the rail head 74. During extension of the cylinder 66, once the jaw 60 engages the web 72 further rotation of the clamp member 42 about the axis of the pivot pin 54 is prevented, and further extension of the cylinder 66 will tend to cause movement of the clamp member 42 in the direction of extension of the end 82 of the cylinder 66. Since the ends 48 of the links 44 pivotally joined to the clamping member 42 are below the pivot axis of the links 44, outward movement of the ends 48 of the links will also cause upward swinging movement of the links about the pivot axis of pivot pin 50, and the links 44 will cause the clamp member 42 to swing upwardly as it moves outwardly with the end 82 of the cylinder 66. Such upward movement of the clamp member 42 causes the engaging surface 90 of the clamp member to clampingly engage the lower surface 76 of the rail head 74.

Thus, whether the rail is new or the rail head is substantially worn, the clamp member 42 will firmly clampingly engage the rail 18 and prevent upward movement of the spike driving machine 10 with respect to the rail 18 when the spikes 12 are driven into the rail.

While in the illustrated arrangement a single hydraulic cylinder 66 is provided, with one end connected to one of the clamp members 42 and an opposite end connected to the other clamp member 42, in other embodiments, separate hydraulic cylinders could be provided for each clamp member 42.

Various features of the invention are set forth in the following claims.

I claim:

1. Apparatus for securing a spike driving machine to the rails of a railroad track when the spike driving machine forces spikes into the ties of the track and to prevent the frame from being lifted away from the rails, and wherein the rails each include a rail head portion supported by a rail web, the rail head portion including a lower surface, the apparatus for securing the machine to the rails comprising:

a clamp member supported for pivotable movement about a pivot axis generally parallel to the longitudinal axis of the rail above the longitudinal axis of the rail, the clamp member including a jaw member spaced from the pivot axis, means for causing pivotable movement of the clamp member from a retracted position to a position wherein the jaw member extends under the head of a rail, the means for causing pivotable movement including a fluid cylinder having one end pivotably connected to the clamp member, means for supporting the clamp member for pivotal movement from the retracted position to a first rail engaging position wherein the jaw member engages the rail web and then for upward movement to a head engaging position wherein the jaw member engages the rail head, said clamp member pivoting from the retracted position to the first rail engaging position when the fluid cylinder extends from a retracted position to a first extended position, and wherein the clamp member moves from the first rail engaging position to the head engaging position when the fluid cylinder extends further to a second extended position, and wherein the means for supporting the clamp member includes a link having opposite ends, one of the opposite ends of the link being pivotally joined to the machine and said clamp member being pivotally joined to the other of the opposite ends of the link.

2. Apparatus set forth in claim 1 and wherein the other of the opposite ends of the link is positioned below the said one of the opposite ends of the link.

3. A machine for driving spikes into railroad ties to secure rails to the ties, the rails including a rail head portion supported by a rail web, and the head portion including a lower surface, the machine comprising:

a frame including a transverse frame member extending transversely to the longitudinal direction of the rails, wheels for supporting the frame for movement along the rails, means supported by the frame for forcing railroad spikes downwardly into the railroad ties to secure the rails in place, and means for securing the frame to the rails when the means for forcing the spikes into the ties forces the spikes downwardly and to prevent the frame from being lifted away from the rails, the means for securing the frame to the rails including a clamp member supported for pivotable movement about a pivot axis generally parallel to the longitudinal axis of the rail and above the longitudinal axis of the rail, one portion of the clamp member defining a jaw member adapted to extend under the rail head and engage the lower surface of said rail head, means for causing pivotable movement of the clamp member from a retracted position, wherein the jaw member is spaced from the rail head, to a position wherein the jaw member extends under the rail head and engages the lower surface, the means for causing pivotable movement including a fluid cylinder having one end pivotalby connected to the clamp member at a position spaced from said jaw member and spaced from the pivot axis, means for supporting the clamp member for pivotal movement from the retracted position to a first rail engaging position wherein the jaw member engages the rail web and then for upward movement to a head engaging position wherein the jaw member engages the lower surface of the rail head, said clamp member designed to pivot from the retracted position to the first rail engaging position when the fluid cylinder extends from a retracted position to a first extended position and wherein the clamp member moves from the first rail engaging position to the head engaging position when the fluid cylinder extends further to a second extended position, and wherein the means for supporting the clamp member includes a link having opposite ends, one of the opposite ends of the link being pivotally joined to the transverse frame member and said clamping member being pivotally joined to the other of the opposite ends of the link.

4. A machine for driving spikes as set forth in claim 3 and wherein the other of the opposite ends of the link is positioned below the said one of the opposite ends of the link.

5. A machine for driving spikes into railroad ties to secure rails to the ties, the rails including a rail head portion supported by a rail web, and the head portion including a lower surface, the machine comprising:

a frame including a transverse frame member extending transversely to the longitudinal direction of the rails, wheels for supporting the frame for movement along rails, means supported by the frame for forcing railroad spikes downwardly into the railroad ties to secure the rails in place, and means for securing the frame to the rails when the means for forcing the spikes into the ties forces the spikes downwardly and to prevent the frame from being lifted away from the rails, the means for securing the frame to the rails including a pair of clamp members, one of the clamp members supported adjacent one of the rails and the other of the clamp members supported adjacent the other of the rails, the clamp members being supported for pivotable movement about axes generally parallel to the longitudinal axes of the rails, and the pivot axes of the clamp members being above the longitudinal axis of the rails, and each of the clamp members including a jaw member spaced from the pivot axis of that clamp member, means for causing pivotable movement of the clamp members from retracted positions to positions wherein the jaw members extend under the rail heads, the means for causing pivotable movement including a fluid cylinder having one end pivotably connected to one of the clamp members and an opposite end pivotably connected to the other of the clamp members, means for supporting each of the clamp members for pivotal movement from the retracted position to a first rail engaging position wherein the jaw member engages the rail web and then for upward movement to a head engaging position wherein the jaw member engages the rail head, said clamp members pivoting from the retracted positions to the first rail engaging positions when the fluid cylinder extends from a retracted position to a first extended position and wherein the clamp member moves from the first position to the head engaging position when the fluid cylinder extends further to a second extended position, and wherein the means for supporting each of the clamping members includes a link having opposite ends, one of the opposite ends of the link being pivotally joined to the transverse frame member and the other of the opposite ends of the link pivotally supporting one of the clamp members for pivotal movement about a pivot axis.

6. A machine for driving spikes as set forth in claim 5 and wherein the other of the opposite ends of the link is positioned below the said one of the opposite ends of the link.

7. A machine for driving spikes into railroad ties to secure rails to the ties, the rails including a rail head portion supported by a rail web, and the head portion including a lower surface, the machine comprising:

a frame including a transverse frame member extending transversely to the longitudinal direction of the rails, wheels for supporting the frame for movement along the rails, means supported by the frame for forcing railroad spikes downwardly into the railroad ties to secure the rails in place, and means for securing the frame to the rails when the means for forcing the spikes into the ties forces the spikes downwardly and to prevent the frame from being lifted away from the rails, the means for securing the frame to the rails including a clamp member supported for pivotable movement about a pivot axis generally parallel to the longitudinal axis of the rail and above the longitudinal axis of the rail, one portion of the clamp member defining a jaw member adapted to extend under the rail head and engage the lower surface, means for causing pivotable movement of the clamp member from a retracted position, wherein the jaw member is spaced from the rail head, to a position wherein the jaw member extends under the rail head and engages the lower surface of said head, the means for causing pivotable movement including a fluid cylinder having one end pivotably connected to the clamp member at a position spaced from said jaw member and spaced from the pivot axis, means for supporting the clamp member for pivotal movement from the retracted position to a first rail engaging position wherein the jaw member engages the rail web and then for upward movement to a head engaging position wherein the jaw member engages the lower surface of the rail head, said clamping member pivoting from the retracted position to the first rail engaging position when the fluid cylinder extends from a retracted position to a first extended position and wherein the clamp member moves from the first rail engaging position to the head engaging position when the fluid cylinder extends further to a second extended position, and wherein the force exerted on one of said rails by said clamping member has a vertical component and a horizontal component which allows said machine to be securely held on said rails by said clamp means located on one side only of each of said rails.

* * * * *